United States Patent [19]

Kando

[11] 4,045,845

[45] Sept. 6, 1977

[54] TOP STOP DEVICE FOR SLIDE FASTENERS

[75] Inventor: Akiyoshi Kando, Uozu, Japan

[73] Assignee: Yoshida Kogyo Kabushiki Kaisha, Japan

[21] Appl. No.: 618,626

[22] Filed: Oct. 1, 1975

[30] Foreign Application Priority Data

Oct. 14, 1974 Japan ..... 49-123746[U]

[51] Int. Cl.[2] ..... A44B 19/36

[52] U.S. Cl. ..... 24/205.11 F

[58] Field of Search ..... 24/205.11 R, 205.11 F

[56] References Cited

U.S. PATENT DOCUMENTS

| | | | |
|---|---|---|---|
| 2,044,161 | 6/1936 | Forster | 24/205.11 R |
| 2,483,703 | 10/1949 | Legat | 24/205.11 R |
| 3,903,571 | 9/1975 | Howell | 24/205.1 R |
| 3,905,073 | 9/1975 | Fukurol | 24/205.11 F |

FOREIGN PATENT DOCUMENTS

| | | | |
|---|---|---|---|
| 782,877 | 9/1957 | United Kingdom | 24/205.11 R |

*Primary Examiner*—Paul R. Gilliam
*Assistant Examiner*—Kenneth J. Dorner
*Attorney, Agent, or Firm*—Bucknam and Archer

[57] ABSTRACT

A pair of top stop members of a synthetic resin are integrally united with several topmost scoops of respective continuous coupling elements of a slide fastener so as to cover at least the head portions of the scoops. In order to prevent deformation of the stop members as a result of forced contact with each other at the end of the fastener closing movement of a slider one of the stop members is made shorter than the other stop member. Thus, when the slider is moved to a topmost position on the rows of coupling elements, the scoop positioned immediately under the lower end of the shorter stop member abuts against the longer stop member, while the stop members themselves are held out of contact with each other.

3 Claims, 3 Drawing Figures

TOP STOP DEVICE FOR SLIDE FASTENERS

BACKGROUND OF THE INVENTION

This invention relates to top stops for limiting the upward movement of a slider in the operation of coupling or closing a slide fastener. More specifically, the invention relates to an improved top stop device for use in a slide fastener having continuous coupling elements made of a filamentary synthetic resin.

There are two well known types of top stops for use in the slide fasteners of the above defined class. One is formed by fusing the scoops of the coupling elements into the stops of desired shape. The other is formed by fusing separate pieces of a synthetic resin onto the respective coupling elements. The first type of top stops are generally flat in shape and are inevitably rather undersized, so that the stops are questionable as to their capability of positively limiting slider movement.

This capability is unquestioned in the second type of top stops. However, as the pair of top stops of this type repeatedly abut against each other just under the neck or separator of the slider body at the end of the fastener closing movement of the slider, either of the stops tend to be deformed or sagging. As a consequence, when the slider is held in place at a topmost or fully closed position on the coupling elements, the top stops may lose a proper angle relative to each other, that is, may become displaced from their predetermined relative positions, and hence make the downward movement of the slider extremely sluggish. For this reason, the slider is prohibited to start moving smoothly downwardly as the slide fastener is opened.

SUMMARY OF THE INVENTION

It is a principal object of this invention to provide an improved top stop device for positively limiting the upward or fastener closing movement of a slider in a slide fastener of the type having continuous coupling elements.

A more specific object of the invention is to provide a top stop device of the second type set forth above, including a pair of stop members which are so constructed and arranged as to avoid contact with each other upon movement of the slider to its fully closed position, so that the device will permit ready downward or fastener opening movement of the slider throughout the useful life of the fastener.

It is also an object of this invention to provide a top stop device of simple and inexpensive construction which can be readily incorporated in conventional slide fasteners of the type described.

With these and other objects in view this invention is directed, in brief, to a top stop device comprising a pair of stop members of synthetic resin material integrally united with respective rows of continuous coupling elements of a slide fastener. Each stop member covers at least the head portions of several topmost scoops of one row of the coupling elements, and projects inwardly beyond the inner edge of one of the stringer tapes of the fastener to the same extent as the heads of the scoops carried thereby. One of the stop members is made shorter than the other stop member; that is, the said other stop member extends farther downwardly than the one stop member.

When the fastener is closed by a slider moved to its topmost position on the coupling elements, therefore, the scoop immediately adjoining the lower end of the one stop member abuts against the other stop member. This adjoining scoop functions to absorb or cushion the shock of contact with the other stop member, so that the stop members are not to be deformed throughout the extended time of use of the fastener.

The features which are believed to be novel and characteristic of this invention are set forth in particular in the appended claims. The invention itself, however, both as to its contruction and manner of functioning, together with the further objects and advantages thereof, will become apparent in the course of the following description, with reference had to the accompanying drawings in which like reference characters denote corresponding parts of the several views.

DESCRIPTION OF THE PREFERRED EMBODIMENTS

Figure 1:
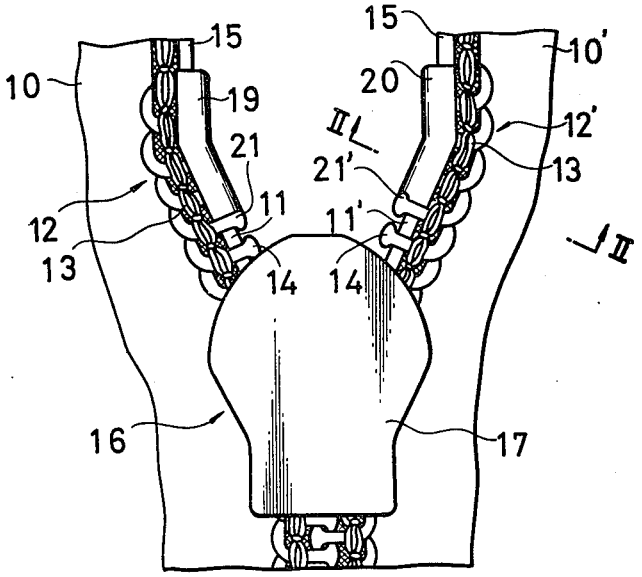
FIG. 1 is a fragmentary rear view of a concealed slide fastener incorporating a preferred form of the top stop device according to this invention.

The invention will now be described more specifically as adapted for use with a concealed slide fastener of well known configuration. As will be seen from FIGS. 1 and 2, the concealed slide fastener includes a pair of stringer tapes 10 and 10' having rearward folds 11 and 11' to which respective rows of continuous coupling elements 12 and 12' are stitched at 13.

Each continuous coupling element 12 or 12' is shown to be of the coil type which may be fashioned from a continuous synthetic-resin filament in the well known manner. The continuous coupling element is formed with a series of scoops constituted of the individual turns of the coiled filament, and each scoop has a head 14 projecting inwardly beyond the inner edge 15 of the corresponding stringer tape 10 or 10'.

The concealed slide fastener also includes a slider 16 movable along the rows of coupling elements 12 and 12' to couple and uncouple the same, that is, to close and open the fastener. The slider 16 includes a body 17 having a separator 18, FIG. 3, arranged centrally at its flared upper end.

According to the novel concepts of this invention there is provided a top stop device comprising a pair of stop members 19 and 20 for limiting the upward on fastener closing movement of the slider 16 along the rows of coupling elements 12 and 12'. These stop members can be made of a suitable synthetic resin such as a polyaminde (nylon) or a polyester.

Figure 2:
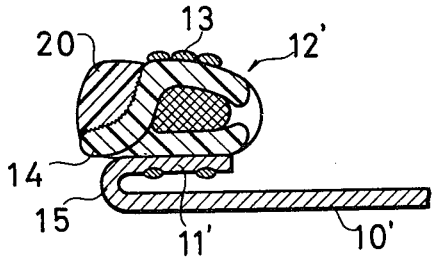
FIG. 2 is an enlarged sectional view taken along the plane of line II—II in FIG. 1.

With particular reference to FIGS. 1 and 2 the stop members 19 and 20 are integrally united, as by the usual technique of thermal fusion, with the respective coupling elements 12 and 12' so as to cover at least the head regions of several topmost scoops of the coupling elements. These stop members project inwardly, or toward each other, beyond the inner edges 15 of the stringer tapes 10 and 10' substantially to the same extent as the heads 14 of the respective coupling elements 12 and 12'. Crosssectionally, the stop members should be so shaped and sized as to enter the usual guide channel in the slider body 17 along with the respective coupling elements.

It will be noted from FIG. 1 that the stop member 19 is longer than the other stop member 20. That is to say, the stop member 19 extends downwardly to a greater extent than the stop member 20. In this particular adaptation of the invention the stop member 19 is made longer than the stop member 20 by approximately a half pitch distance between the scoops of each coupling element 12 or 12'. The lower ends of the stop members 19 and 20 are disposed close to, or in direct contact with, the underlying scoops 21 and 21', respectively.

Each stop member 19 or 20 is shown to be bent substantially into the shape of a V. This is to prevent the upper ends of the stringer tapes 10 and 10' from spreading apart when the fastener is closed.

Figure 3:
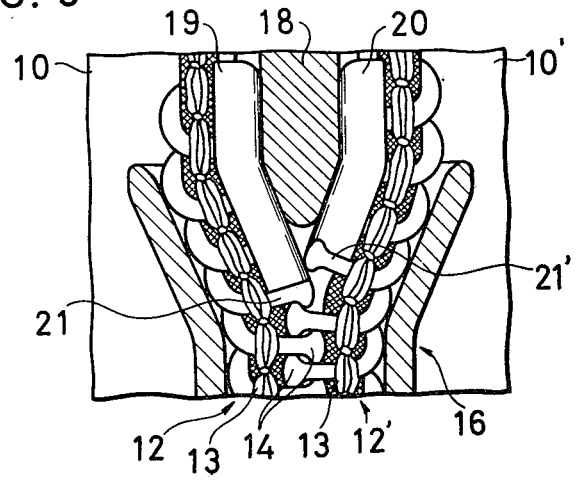
FIG. 3 is a fragmentary rear view of the slide fastener of FIG. 1 when the same is closed, in which the slider is shown partly broken away to reveal the relative positions of the pair of stop members of the top stop device and other associated parts of the fastener.

Thus, when the slider 16 is moved to a predetermined topmost or fully closed position on the rows of coupling elements 12 and 12' as shown in FIG. 3, the head 14 of the scoop 21' immediately underlying the lower end of the shorter stop member 20 abuts against the inner edge of the longer stop member 19 just under the separator 18 of the slider body 17. Since the stop members 19 and 20 are thus prevented from striking or pressing against each other at the end of the fastener closing movement of the slider 16, the stop members are prevented from being deformed or sagging and hence are capable of positively limiting the movement of the slider in their predetermined angularly spaced positions within the slider throughout the life of the slide fastener.

While but one specific adaptation of the slider top stop device according to this invention has been shown and described hereinbefore, it is understood that this adaptation is merely for the purpose of illustration and decription and that various other adaptions may be resorted to by one skilled in the art without departing from the scope of the invention as defined in the claims which follow.

What is claimed is:

1. In a slide fastener of the type including a pair of stringer tapes carrying along their opposed inner edges respective rows of continuous coupling elements which are mutually engageable and disengageable by a slider moving therealong, each row of coupling elements being formed with a plurality of scoops each having a head projecting inwardly beyond the inner edge of one of the stringer tapes, a top stop device comprising, in combination, a pair of stop members of a synthetic resin each united with one of said rows of coupling elements so as to cover at least the head regions of several topmost scoops thereof, each said stop member projecting inwardly beyond the inner edge of one of said stringer tapes substantially to the same extent as said heads of the scoops carried thereby, one of said stop members being shorter than the other stop member and at least the end of said shorter stop member being disposed in direct contact with one of the underlying scoops whereby, upon movement of said slider along said rows of coupling elements to a predetermined topmost position thereon, the scoop immediately underlying the lower end of said one stop member abuts against the inner edge of said other stop member.

2. A top stop device as defined in claim 1 wherein said continuous coupling elements are formed from a plastics filament into a coil structure.

3. A top stop device as defined in claim 1 wherein said slide fastener is of the concealed type which includes a pair of stringer tapes having rearward folds to which respective rows of continuous coupling elements are secured.

* * * * *